US011373590B2

(12) United States Patent
Yuan et al.

(10) Patent No.: US 11,373,590 B2
(45) Date of Patent: Jun. 28, 2022

(54) DISPLAY PANEL, DRIVING METHOD THEREOF, AND DISPLAY DEVICE

(71) Applicant: Xiamen Tianma Micro-Electronics Co., Ltd., Xiamen (CN)

(72) Inventors: Yong Yuan, Xiamen (CN); Jieliang Li, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/467,994

(22) Filed: Sep. 7, 2021

(65) Prior Publication Data

US 2021/0407384 A1 Dec. 30, 2021

(30) Foreign Application Priority Data

Oct. 23, 2020 (CN) ..... 202011150068.X

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0819* (2013.01); *G09G 2300/0852* (2013.01); *G09G 2300/0861* (2013.01); *G09G 2320/0233* (2013.01); *G09G 2320/045* (2013.01)

(58) Field of Classification Search
CPC ... G09G 3/32–3291; G09G 2300/0819; G09G 2300/0852; G09G 2300/0861; G09G 2320/0233; G09G 2320/045
See application file for complete search history.

(56) References Cited

U.S. PATENT DOCUMENTS

| | | | | |
|---|---|---|---|---|
| 9,564,082 | B2 * | 2/2017 | Qing | G09G 3/3225 |
| 2013/0300724 | A1 * | 11/2013 | Chaji | G09G 3/3258 345/212 |
| 2014/0218415 | A1 * | 8/2014 | Pak | G09G 3/3291 345/212 |
| 2021/0134917 | A1 * | 5/2021 | Li | G09G 3/3266 |

* cited by examiner

*Primary Examiner* — Gene W Lee
(74) *Attorney, Agent, or Firm* — von Briesen & Roper, s.c.

(57) ABSTRACT

Provided are a display panel, a driving method thereof, and a display device. The display panel includes a pixel circuit and a light-emitting element; where the pixel circuit includes a drive module, a data writing module, a light emission control module, and a bias module; where the drive module is configured to provide the light-emitting element with a drive current and includes a drive transistor; the data writing module is connected to a source of the drive transistor and configured to selectively provide the drive module with a data signal; the light emission control module is configured to selectively allow the light-emitting element to enter a light-emitting stage; the bias module is connected between a drain of the drive transistor and the light emission control signal line.

20 Claims, 11 Drawing Sheets

DISPLAY PANEL, DRIVING METHOD THEREOF, AND DISPLAY DEVICE

CROSS-REFERENCE TO RELATED APPLICATION(S)

This application claims priority to Chinese Patent Application No. 202011150068.X filed Oct. 23, 2020, the disclosure of which is incorporated herein by reference in its entirety.

TECHNICAL FIELD

The present disclosure relates to display technologies and, in particular, to a display panel, a driving method thereof, and a display device.

BACKGROUND

In a display panel, a pixel circuit provides a light-emitting element of the display panel with a drive current required for display and controls whether the light-emitting element enters a light-emitting stage. The pixel circuit is an indispensable element in most self-luminous display panels.

However, as the use time of an existing display panel increases, the internal characteristics of a drive transistor in the pixel circuit change slowly, resulting in the drift of the threshold voltage of the drive transistor, so that the comprehensive characteristics of the drive transistor are affected and then display uniformity is affected.

SUMMARY

The embodiments of the present disclosure provide a display panel, a driving method thereof, and a display device, so as to reduce a drift of a threshold voltage of an existing drive transistor.

The embodiments of the present disclosure provide a display panel including a pixel circuit and a light-emitting element.

The pixel circuit includes a drive module, a data writing module, a light emission control module, and a bias module.

The drive module is configured to provide the light-emitting element with a drive current and includes a drive transistor.

The data writing module is connected to a source of the drive transistor and configured to selectively provide the drive module with a data signal.

The light emission control module is configured to selectively allow the light-emitting element to enter a light-emitting stage.

A control terminal of the light emission control module is connected to a light emission control signal line for receiving a light emission control signal. The bias module is connected between a drain of the drive transistor and the light emission control signal line.

A working process of the pixel circuit includes a bias stage at which the bias module adjusts a drain potential of the drive transistor according to the light emission control signal.

Based on the same concept, the embodiments of the present disclosure further provide a driving method of a display panel.

The display panel includes a pixel circuit and a light-emitting element.

The pixel circuit includes a drive module, a data writing module, a light emission control module, and a bias module.

The drive module is configured to provide the light-emitting element with a drive current and includes a drive transistor.

The data writing module is connected to a source of the drive transistor and configured to selectively provide the drive module with a data signal.

The light emission control module is configured to selectively allow the light-emitting element to enter a light-emitting stage.

A control terminal of the light emission control module is connected to a light emission control signal line for receiving a light emission control signal. The bias module is connected between a drain of the drive transistor and the light emission control signal line.

A working process of the pixel circuit includes a bias stage at which the bias module adjusts a drain potential of the drive transistor according to the light emission control signal.

A driving method for at least one frame of picture of the display panel includes steps described below.

In a case where a transistor in the light emission control module and the drive transistor are P-type metal-oxide-semiconductor (PMOS) transistors, at the bias stage, the light emission control signal line receives a high-level signal and the bias module increases the drain potential of the drive transistor according to the high-level signal to enable the drive transistor to enter a bias state.

Alternatively, in a case where a transistor in the light emission control module and the drive transistor are N-type metal-oxide-semiconductor (NMOS) transistors, at the bias stage, the light emission control signal line receives a low-level signal and the bias module decreases the drain potential of the drive transistor according to the low-level signal to enable the drive transistor to enter a bias state.

Based on the same concept, the embodiments of the present disclosure further provide a display device including the display panel described above.

In the embodiments of the present disclosure, the pixel circuit includes the bias module which is connected between the light emission control signal line and the drain of the drive transistor to adjust the drain potential of the drive transistor and improve a potential difference between a gate potential of the drive transistor and the drain potential of the drive transistor. It is known that the pixel circuit includes at least one non-bias stage. When the drive transistor generates the drive current, the gate potential of the drive transistor might be higher than the drain potential of the drive transistor, so that an I-V curve of the drive transistor deviates, resulting in a threshold voltage drift of the drive transistor. At the bias stage, the gate potential and the drain potential of the drive transistor are adjusted, so that the deviation of the I-V curve of the drive transistor at the non-bias stage can be balanced, thereby reducing the threshold voltage drift of the drive transistor and ensuring the display uniformity of the display panel.

BRIEF DESCRIPTION OF DRAWINGS

To illustrate the solutions in the embodiments of the present disclosure or in the related art more clearly, the drawings used in the description of the embodiments or the related art will be briefly described below. Apparently, though the drawings described below illustrate some embodiments of the present disclosure, those skilled in the art may obtain other structures and drawings according to the basic concepts of the device structures, the driving method, and the manufacturing method disclosed by various embodiments of the present disclosure, all of which should fall within the scope of the claims of the present disclosure without any doubt.

DETAILED DESCRIPTION

The solutions of the present disclosure will be described clearly and completely with reference to the accompanying drawings through embodiments from which the objects, solutions, and advantages of the present disclosure will be more apparent. Apparently, the embodiments described herein are part, not all, of the embodiments of the present disclosure. All other embodiments obtained by those skilled in the art based on the basic concepts disclosed by the embodiments of the present disclosure are within the scope of the present disclosure.

Figure 1:
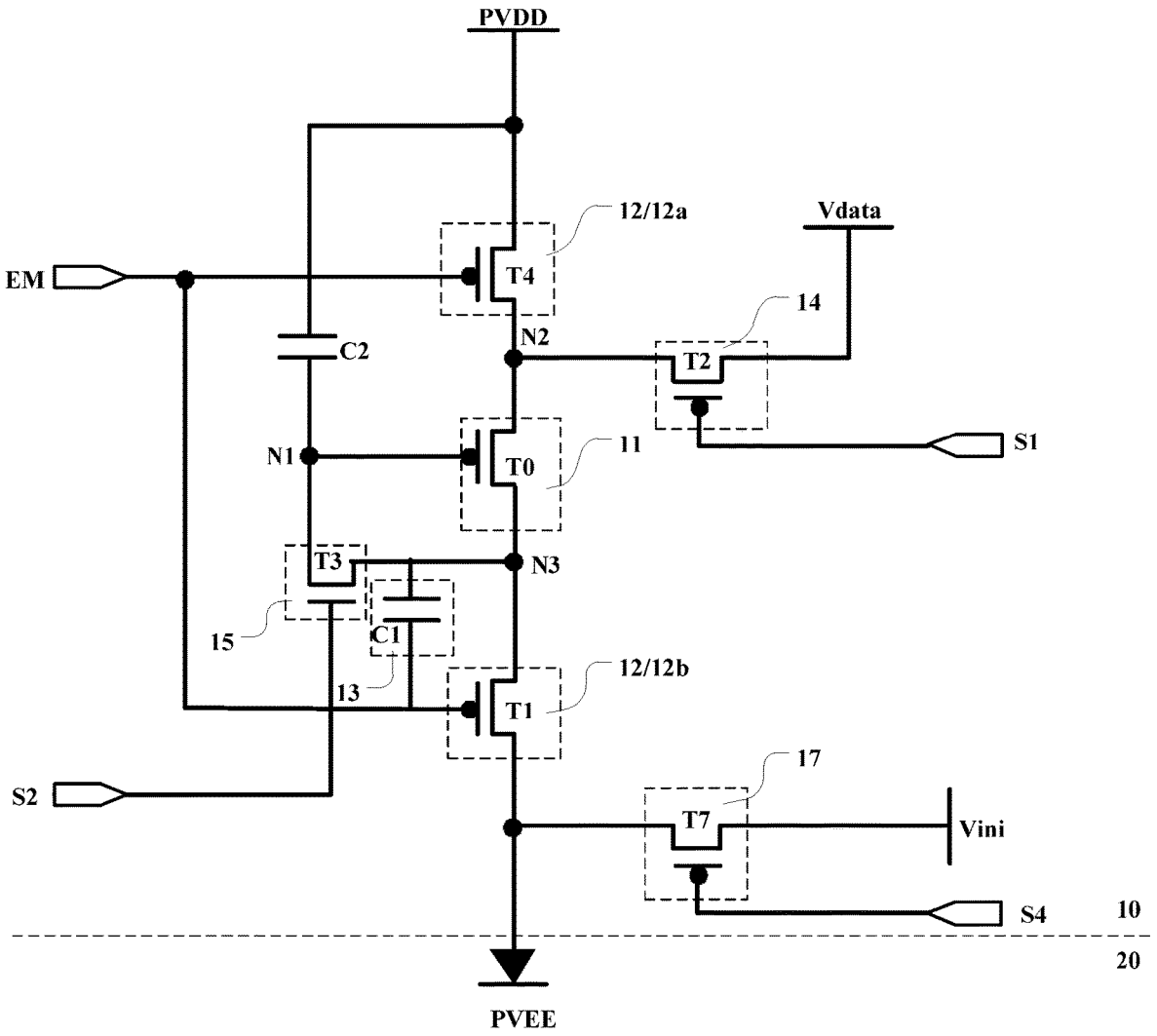
FIG. 1 is a schematic diagram of a first pixel circuit of a display panel according to an embodiment of the present disclosure.

FIG. 1 is a schematic diagram of a first pixel circuit of a display panel according to an embodiment of the present disclosure. Referring to FIG. 1, the display panel provided by this embodiment includes a pixel circuit 10 and a light-emitting element 20; where the pixel circuit 10 includes a drive module 11, a light emission control module 12, a bias module 13, and a data writing module 14; where the drive module 11 is configured to provide the light-emitting element 20 with a drive current and includes a drive transistor T0; the light emission control module 12 is configured to selectively allow the light-emitting element 20 to enter a light-emitting stage; the data writing module 14 is connected to a source of the drive transistor T0 and configured to selectively provide the drive module 11 with a data signal Vdata; a control terminal of the light emission control module 12 is connected to a light emission control signal line for receiving a light emission control signal EM; and the bias module 13 is connected between a drain of the drive transistor T0 and the light emission control signal line. A working process of the pixel circuit 10 includes a bias stage at which the bias module 13 adjusts a drain potential of the drive transistor T0 according to the light emission control signal EM.

In this embodiment, the pixel circuit 10 includes the drive module 11, and an output terminal of the drive module 11 (i.e., the drain) is electrically connected to the light-emitting element 20. The drive module 11 includes the drive transistor T0. After the drive transistor T0 is turned on, the drive module 11 provides the light-emitting element 20 with the drive current. The on-off of the drive transistor T0 controls the magnitude of the drive current provided for the light-emitting element 20. The source of the drive transistor T0 is electrically connected to an input terminal of the drive module 11 and the drain of the drive transistor T0 is electrically connected to the output terminal of the drive module 11. In other embodiments, it is further optional that the drain of the drive transistor is electrically connected to the input terminal of the drive module and the source of the drive transistor is electrically connected to the output terminal of the drive module. It is understandable that the source and the drain of the transistor are not constant but will change as a drive state of the transistor changes.

The pixel circuit 10 includes the data writing module 14, where a source of the data writing module 14 is connected to a data signal terminal for receiving the data signal Vdata, a drain of the data writing module 14 is connected to the source of the drive transistor T0, and a control terminal of the data writing module 14 is connected to a first scanning signal line for receiving a first scanning signal S1 which controls the data writing module 14 to be turned on and off. In an embodiment, the data writing module includes a second transistor T2, where a source of the second transistor T2 is connected to the data signal terminal, a drain of the second transistor T2 is connected to the source of the drive transistor T0, and a gate of the second transistor T2 is connected to the first scanning signal line.

The pixel circuit 10 includes the light emission control module 12, where the control terminal of the light emission control module 12 is connected to the light emission control signal line EM. When the light emission control signal line EM outputs an effective pulse, the light emission control module 12 is turned on and drives the light-emitting element 20 to enter the light-emitting stage, and the drive current flows into the light-emitting element 20. When the light emission control signal line EM outputs an invalid pulse, the light emission control module 12 is turned off and a path through which the drive current flows into the light-emitting element 20 is disconnected.

The pixel circuit 10 includes the bias module 13 which is connected between the drain of the drive transistor T0 and the light emission control signal line EM. The bias module 13 is configured to increase or decrease the drain potential of the drive transistor T0. In an example in which the drive transistor T0 is a PMOS transistor, the light emission control signal line EM receives a high-level signal and the bias module 13 increases the drain voltage of the drive transistor T0. In other embodiment, it is further optional that the drive transistor is an NMOS transistor, the light emission control signal line EM receives a low-level signal, and the bias module 13 decreases the drain voltage of the drive transistor T0. The following embodiments are described by using an example in which the drive transistor is the PMOS transistor.

At a non-bias stage such as the light-emitting stage of the pixel circuit, a gate potential of the drive transistor might be higher than the drain potential of the drive transistor, which will cause ion polarization inside the drive transistor in long-term use and form a built-in electric field inside the drive transistor, so that an Id-Vg curve deviates, a threshold voltage of the drive transistor continuously increases, and the drive current flowing into the light-emitting element is affected, affecting display uniformity. In this embodiment, in the working process of the pixel circuit 10, the bias module 13 adjusts the drain voltage of the drive transistor T0, so as to reduce the degree of ion polarization inside the drive transistor T0 and compensate for the threshold voltage drift of the drive transistor T0.

In the embodiments of the present disclosure, the pixel circuit includes the bias module which is connected between the light emission control signal line and the drain of the drive transistor to adjust the drain potential of the drive transistor and improve a potential difference between the gate potential of the drive transistor and the drain potential of the drive transistor. It is known that the pixel circuit includes at least one non-bias stage. When the drive transistor generates the drive current, the gate potential of the drive transistor might be higher than the drain potential of the drive transistor, so that an I-V curve of the drive transistor deviates, resulting in the threshold voltage drift of the drive transistor. At the bias stage, the gate potential and the drain potential of the drive transistor are adjusted, so that the deviation of the I-V curve of the drive transistor at the non-bias stage can be balanced, thereby reducing the threshold voltage drift of the drive transistor and ensuring the display uniformity of the display panel.

In an embodiment, the working process of the pixel circuit further includes at least one non-bias stage; at the bias stage, the drive transistor has a gate voltage of Vg1, a source voltage of Vs1, and a drain voltage of Vd1; and at the non-bias stage, the drive transistor has a gate voltage of Vg2, a source voltage of Vs2, and a drain voltage of Vd2; where $|Vg1-Vd1|<|Vg2-Vd2|$.

In this case, the potential difference between the gate potential of the drive transistor T0 and the drain potential of the drive transistor T0 is reduced, so as to alleviate the threshold voltage drift due to the potential difference between the gate potential of the drive transistor T0 and the drain potential of the drive transistor T0 at the non-bias stage.

In addition, in some implementations of this embodiment, $(Vg1-Vs1)\times(Vg2-Vs2)<0$ or $(Vg1-Vd1)\times(Vg2-Vd2)<0$.

In the working process of the pixel circuit, the gate voltage and the drain voltage of the drive transistor satisfy that $(Vg1-Vd1)\times(Vg2-Vd2)<0$. At the non-bias stage, the gate voltage of the drive transistor is higher than the drain voltage of the drive transistor in the pixel circuit, that is, $Vg2>Vd2$, and then $Vg2-Vd2>0$. At the bias stage, the data signal is written to the drain of the drive transistor, so that the gate voltage of the drive transistor is lower than the drain voltage of the drive transistor, that is, $Vg1<Vd2$, and then $Vg1-Vd1<0$. Then, $(Vg1-Vd1)\times(Vg2-Vd2)<0$.

In other embodiments, in the working process of the pixel circuit, the gate voltage and the source voltage of the drive transistor satisfy that $(Vg1-Vs1)\times(Vg2-Vs2)<0$ if the source and the drain of the drive transistor are interchanged. At the non-bias stage, the gate voltage of the drive transistor is higher than the source voltage of the drive transistor in the pixel circuit, that is, $Vg2>Vs2$, and then $Vg2-Vs2>0$. At the bias stage, the data signal is written to the source of the drive transistor, so that the gate voltage of the drive transistor is lower than the source voltage of the drive transistor, that is, $Vg1<Vs2$, and then $Vg1-Vs1<0$. Then, $(Vg1-Vs1)\times(Vg2-Vs2)<0$.

In addition, in this embodiment, since the non-bias stage such as the light-emitting stage of the display panel is relatively long, it may be set that $Vd1-Vg1>Vg2-Vd2>0$ to fully balance, at the bias stage, the threshold voltage drift at the non-bias stage and avoid taking so long a time at the bias stage. In this way, Vd1 is much higher than Vg1 at the bias stage so that the expected bias effect can be achieved as soon as possible at the bias stage. In other embodiments, if the source and the drain of the drive transistor are interchanged, it may be set that $Vs1-Vg1>Vg2-Vs2>0$, which depends on a specific circuit.

In an embodiment, in other implementations of this embodiment, the bias stage has a duration of t1 and the non-bias stage has a duration of t2, where $(|Vg1-Vs1|-|Vg2-Vs2|)\times(t1-t2)<0$ or $(|Vg1-Vd1|-|Vg2-Vd2|)\times(t2-t2)<0$.

In this embodiment, at the bias stage, the drain voltage of the drive transistor is made higher than the gate voltage of the drive transistor, that is, $Vg1-Vd1<0$. At the non-bias stage, the gate voltage of the drive transistor is higher than the drain voltage of the drive transistor, that is, $Vg2-Vd2>0$. When the drive transistor is biased, in response to a relatively large bias voltage, bias time may be appropriately reduced, and in response to a relatively small bias voltage, the bias time may be appropriately prolonged.

Based on this, that $|Vg1-Vd1|-|Vg2-Vd2|>0$ indicates a relatively large bias voltage and the duration of the bias stage may be appropriately reduced, that is, $t1<t2$, so as to reduce the deviation between threshold voltages at the bias stage and the non-bias stage. That $|Vg1-Vd1|-|Vg2-Vd2|<0$ indicates a relatively small bias voltage and the duration of the bias stage may be appropriately prolonged, that is, $t1>t2$, so as to reduce the deviation between threshold voltages at the bias stage and the non-bias stage.

In other embodiments, if the source and the drain of the drive transistor are interchanged, the gate and the drain of the drive transistor at the bias stage and the non-bias stage satisfy that $(|Vg1-Vs1|-|Vg2-Vs2|)\times(t1-t2)<0$, so as to reduce the threshold voltage deviation at the non-bias stage.

It is to be noted that the bias stage and the non-bias stage in the above implementations, especially those involving a duration comparison, generally refer to a continuous bias stage and a continuous non-bias stage to be compared.

In an embodiment, the non-bias stage is the light-emitting stage of the display panel. Exemplarily, at the light-emitting stage, the drive transistor T0 has a source voltage of 4.6 V, a gate voltage of 3 V, and a drain voltage of 1 V, and the gate voltage of the drive transistor is higher than the drain voltage of the drive transistor. At the bias stage, the drive transistor is biased to compensate for the threshold voltage drift of the drive transistor at the light-emitting stage.

In this embodiment, the transistor in the light emission control module 12 and the drive transistor T0 are the same type of transistors. If they are both the PMOS transistors, at the bias stage, the light emission control signal line receives the high-level signal and the bias module 13 increases the drain voltage of the drive transistor T0 according to the high-level signal. Alternatively, if the transistor in the light emission control module 12 and the drive transistor T0 are both the NMOS transistors, at the bias stage, the light emission control signal line receives the low-level signal and the bias module decreases the drain voltage of the drive transistor T0 according to the low-level signal. The bias module 13 adjusts the drain potential of the drive transistor T0 according to the light emission control signal EM.

In an embodiment, as shown in FIG. 1, the pixel circuit 10 further includes a compensation module 15, where the compensation module 15 is connected between the gate of the drive transistor T0 and the drain of the drive transistor T0 and configured to compensate a threshold voltage of the drive transistor T0; and a control terminal of the compensation module 15 is connected to a second scanning signal line for receiving a second scanning signal S2 which controls the compensation module 15 to be turned on or off. At the bias stage, the compensation module 15 remains off. Since the potential difference between the gate potential and the drain potential of the drive transistor T0 is adjusted at the bias stage and the compensation module 15 is connected between the gate and the drain of the drive transistor T0, if the compensation module 15 is turned on, the gate potential will be basically equal to the drain potential. Therefore, at the bias stage, the compensation module 15 remains off. In an embodiment, the compensation module 15 includes a third transistor T3, where a source of the third transistor T3 is connected to the drain of the drive transistor T0, a drain of the third transistor T3 is connected to the gate of the drive transistor T0, and a gate of the third transistor T3 is connected to the second scanning signal line for receiving the second scanning signal S2.

Figure 2:
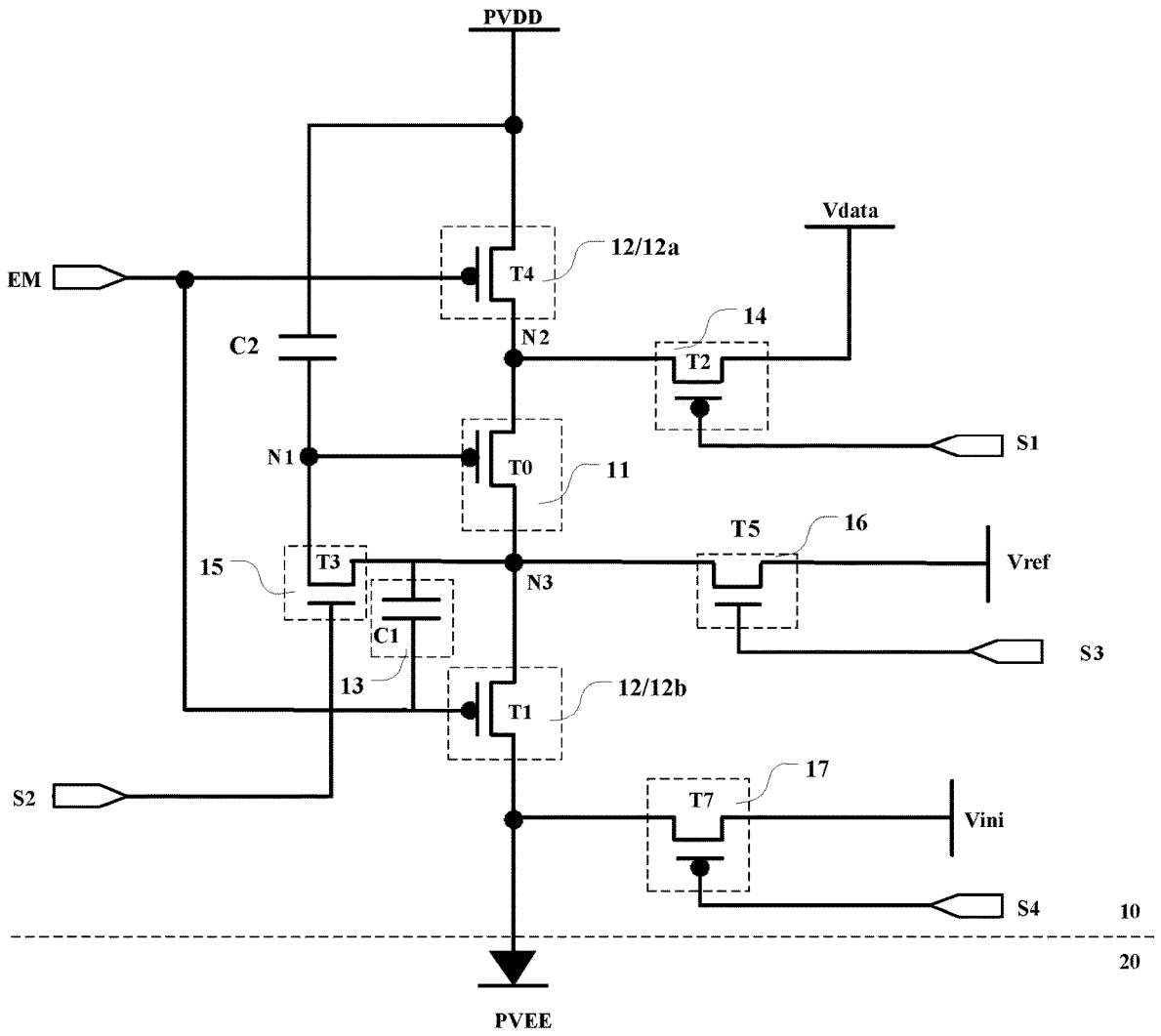
FIG. 2 is a schematic diagram of a second pixel circuit of a display panel according to an embodiment of the present disclosure.
Figure 3:
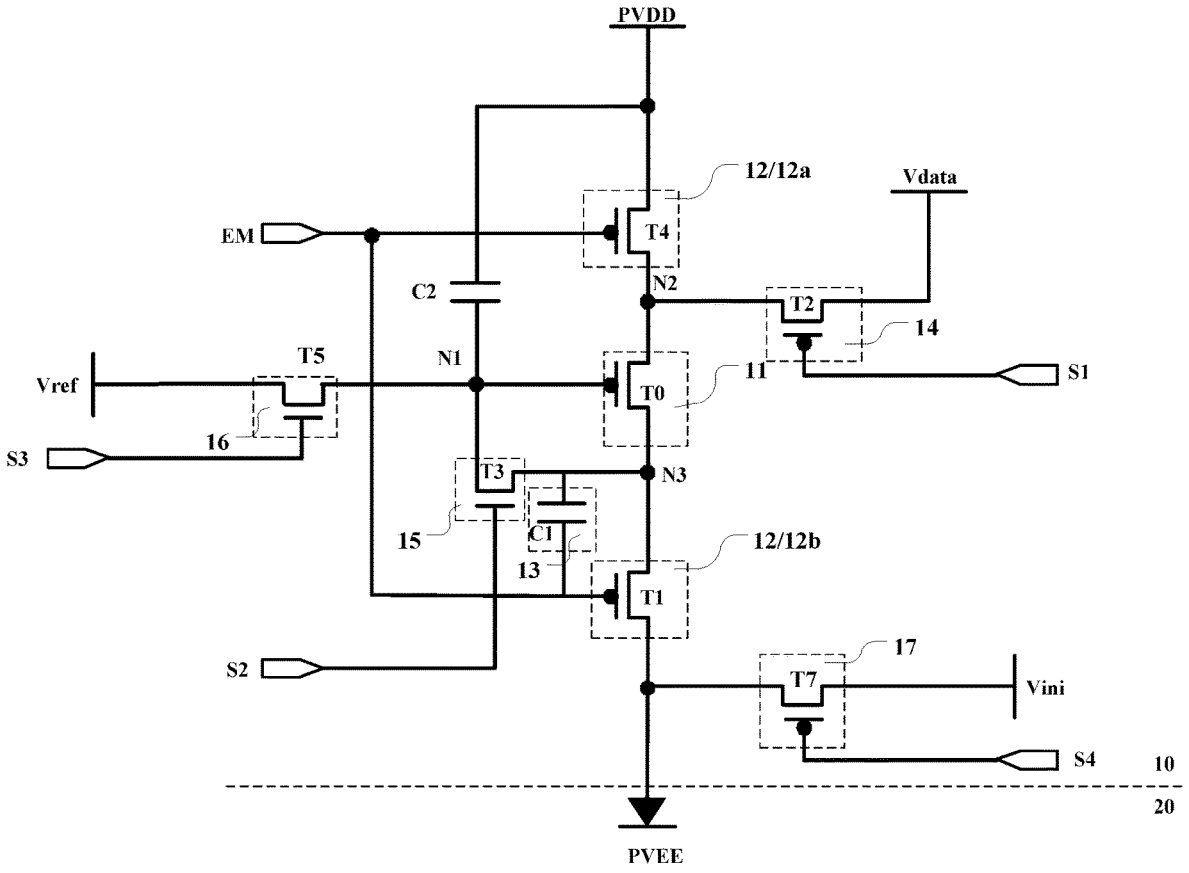
FIG. 3 is a schematic diagram of a third pixel circuit of a display panel according to an embodiment of the present disclosure.

In an embodiment, FIG. 2 is a schematic diagram of a second pixel circuit of a display panel according to an embodiment of the present disclosure and FIG. 3 is a schematic diagram of a third pixel circuit of a display panel according to an embodiment of the present disclosure. In this embodiment, referring to FIGS. 2 and 3, the pixel circuit 10 further includes a reset module 16. In an embodiment, as shown in FIG. 2, the reset module 16 is connected between a reset signal terminal and the drain of the drive transistor T0 and configured to provide the gate of the drive transistor T0 with a reset signal Vref. Alternatively, in an embodiment, as shown in FIG. 3, the reset module 16 is connected between the reset signal terminal and the gate of the drive transistor T0 and configured to provide the gate of the drive transistor T0 with the reset signal Vref.

Figure 4:
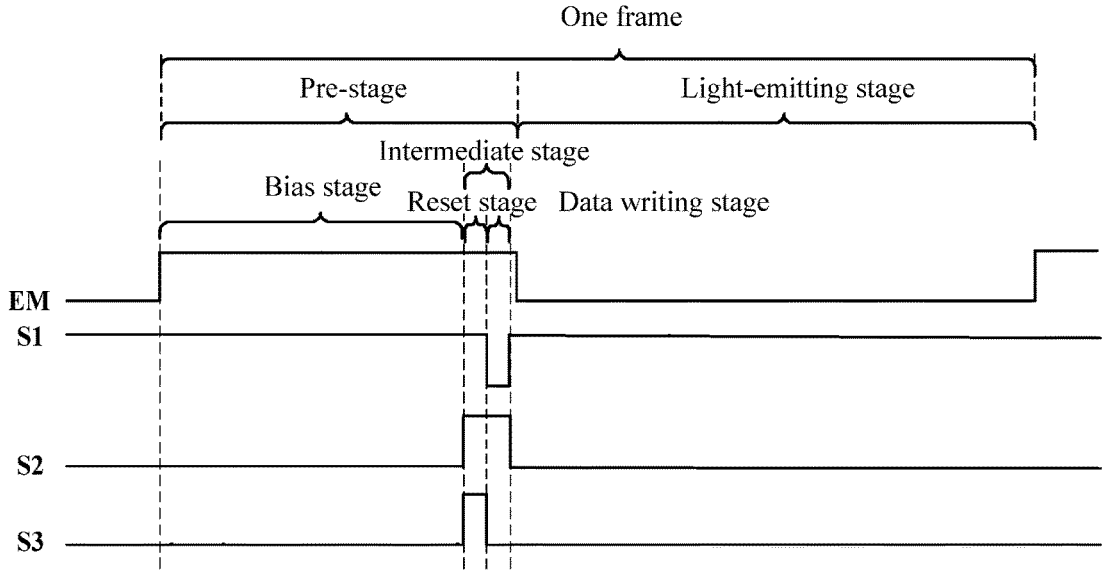
FIG. 4 is a schematic diagram of a first working timing sequence of a pixel circuit.
Figure 5:
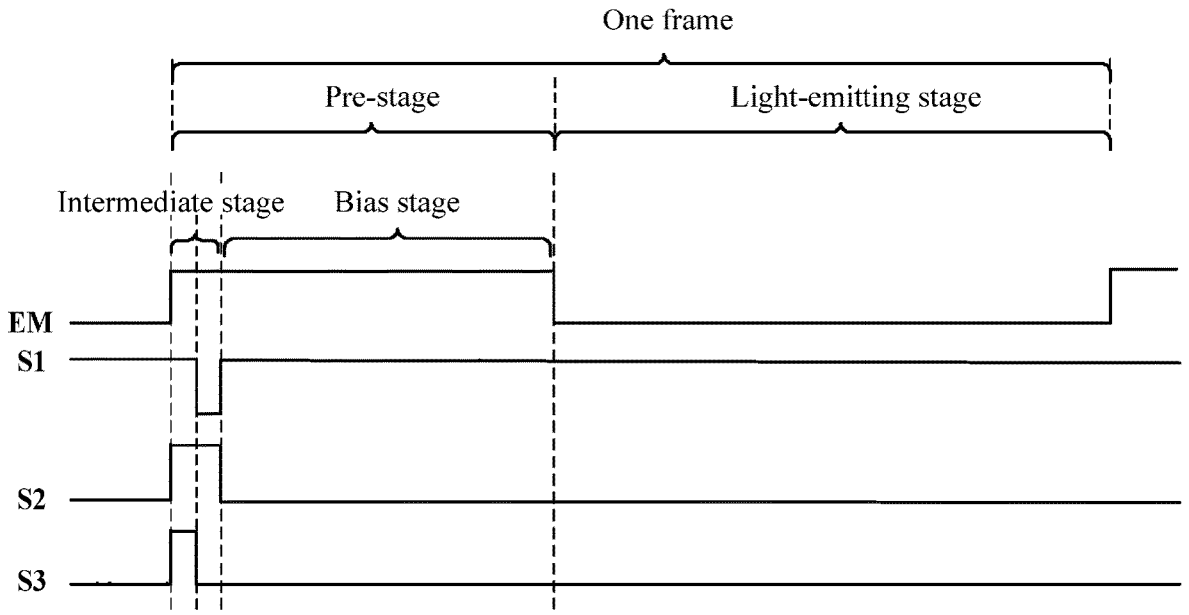
FIG. 5 is a schematic diagram of a second working timing sequence of a pixel circuit.
Figure 6:
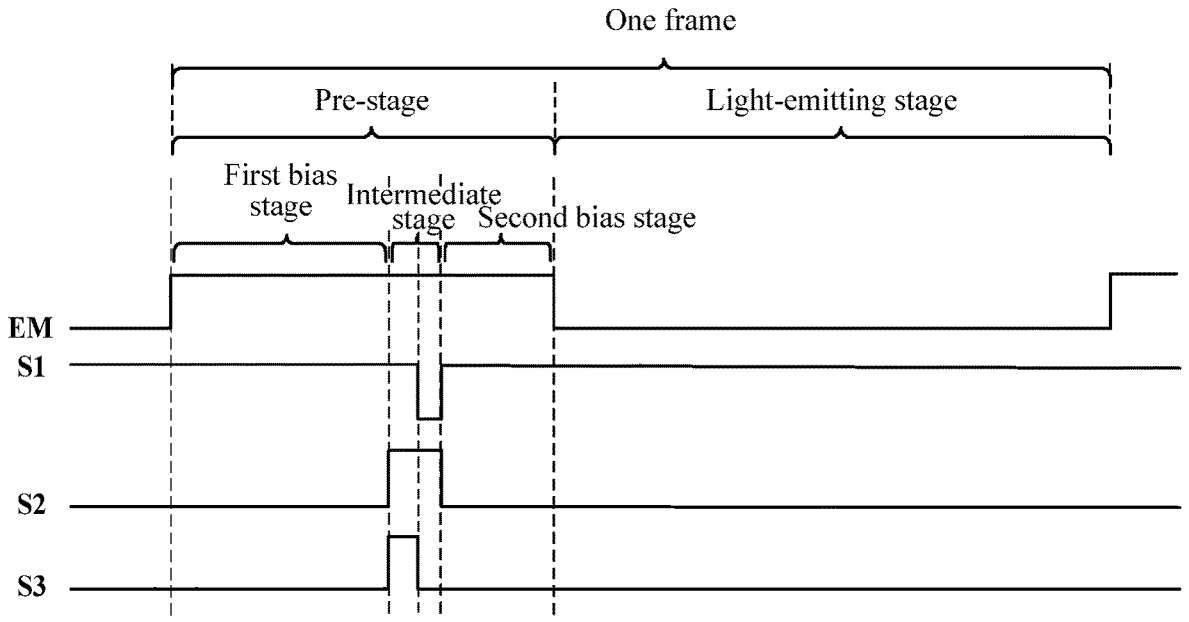
FIG. 6 is a schematic diagram of a third working timing sequence of a pixel circuit.

The pixel circuit shown in FIG. 2 is used as an example here. Reference is made to FIGS. 4 to 6, where FIG. 4 is a schematic diagram of a first working timing sequence of the pixel circuit, FIG. 5 is a schematic diagram of a second working timing sequence of the pixel circuit, and FIG. 6 is a schematic diagram of a third working timing sequence of the pixel circuit. It is to be noted that the terms such as "first" present here and below are merely intended to distinguish different schematic diagrams and should not be construed as a sequence of the schematic diagrams. In addition, optionally, the third transistor T3 and a fifth transistor T5 are NMOS transistors and the other transistors are PMOS transistors, where the NMOS transistors may be oxide semiconductor transistors.

In an embodiment, as shown in FIGS. 4 to 6, within one frame of picture of the display panel, the working process of the pixel circuit includes a pre-stage and the light-emitting stage; where within at least one frame of picture, the pre-stage of the pixel circuit includes the bias stage.

In this embodiment, the pre-stage includes the bias stage and an intermediate stage; where at the bias stage, the compensation module 15 is turned off; at the intermediate stage, the compensation module 15 is turned on. As shown in FIG. 4, the bias stage precedes the intermediate stage. Alternatively, as shown in FIG. 5, the bias stage is after the intermediate stage. Moreover, as shown in FIG. 6, when the pre-stage includes at least two bias stages, the intermediate stage may exist between any adjacent two bias stages. This will be further described in detail hereinafter.

In this embodiment, a data writing period of the display panel includes S frames of a refresh picture which includes a data writing frame and a retention frame, where S>0; the data writing frame includes a data writing stage; and the retention frame includes no data writing stage.

In this embodiment, referring to FIGS. 2 and 4, the data writing frame includes the bias stage; where the intermediate stage includes a reset stage and the data writing stage in sequence; at the reset stage, the reset module 16 and the compensation module 15 are turned on and the gate of the drive transistor T0 receives the reset signal to be reset; and at the data writing stage, the data writing module 14, the drive module 11, and the compensation module 15 are all turned on and the data signal is written to the gate of the drive transistor T0. Since the data writing frame includes the data writing stage and the gate of the drive transistor T0 needs to be reset before the data writing stage, the pre-stage of the data writing frame needs to include the reset stage and the data writing stage. At other stages of the pre-stage, the compensation module may remain off, and the drain potential of the drive transistor T0 is increased under the control of the light emission control signal EM and the bias module 13.

In an embodiment, in the case where the data writing frame includes the bias stage, the reset stage may be further included before the bias stage, and then the bias stage is entered. Since the potential difference between the gate and the drain of the drive transistor T0 is adjusted at the bias stage, the reset stage is performed before the bias stage. For example, if the drive transistor is the PMOS transistor, the gate of the drive transistor may be provided with the low-level signal at the reset stage to be reset; then, at the bias stage, the compensation module is turned off and the drain potential of the drive transistor is increased under the action of the light emission control signal EM and the bias module 13. The above process adjusts both the gate potential and the drain potential of the drive transistor, thereby improving a bias effect.

Figure 7:
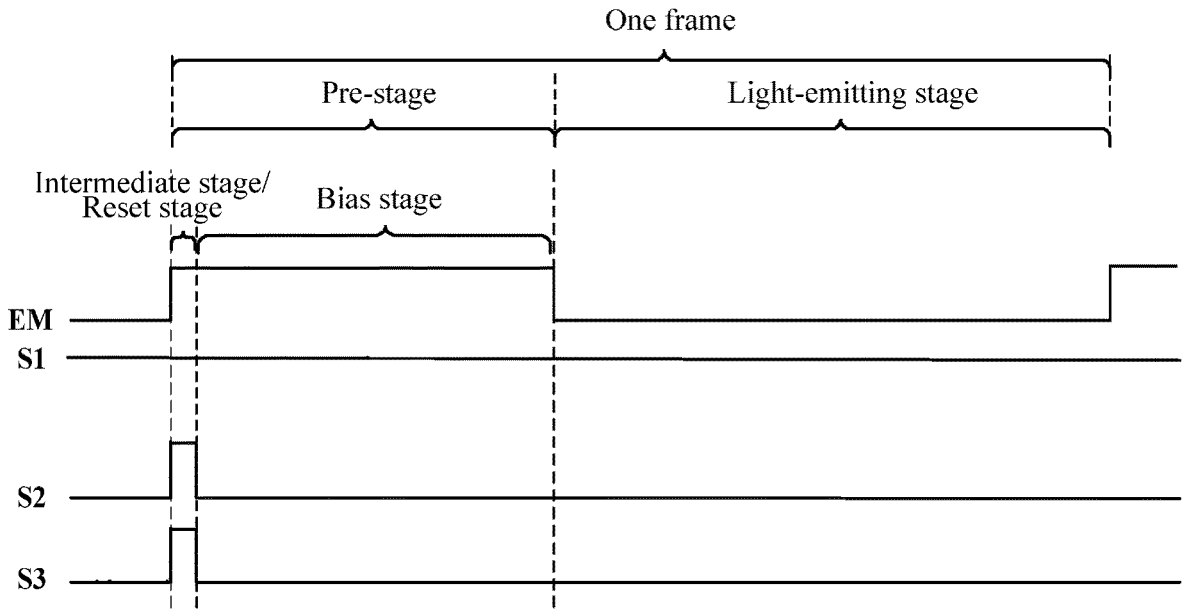
FIG. 7 is a schematic diagram of a fourth working timing sequence of a pixel circuit.

FIG. 7 is a schematic diagram of a fourth working timing sequence of the pixel circuit. Referring to FIG. 7, the retention frame includes the bias stage and the intermediate stage includes the reset stage. At the reset stage, the reset module 16 and the compensation module 15 are turned on and the gate of the drive transistor T0 receives the reset signal Vref to be reset. The retention frame includes no data writing stage. Therefore, if the pre-stage of the retention frame includes the bias stage and the retention frame further includes the reset stage in conjunction with the pixel circuit in FIG. 2, the intermediate stage includes the reset stage. In an embodiment, the reset stage may be performed before the bias stage or after the bias stage. When the pre-stage includes at least two bias stages, the reset stage may also be performed between any adjacent two intermediate stages. In an embodiment, the reset stage precedes the bias stage. Since the potential difference between the gate and the drain of the drive transistor T0 is adjusted at the bias stage, the reset stage is performed before the bias stage. For example, if the drive transistor is the PMOS transistor, the gate of the drive transistor may be provided with the low-level signal at the reset stage to be reset; then, at the bias stage, the compensation module is turned off and the drain potential of the drive transistor is increased under the action of the light emission control signal EM and the bias module 13 The above process adjusts both the gate potential and the drain potential of the drive transistor, thereby improving the bias effect.

In an embodiment, the data writing period of the display panel includes the S frames of the refresh picture which includes the data writing frame and the retention frame, where S>0; the data writing frame includes the data writing stage; and the retention frame includes no data writing stage.

Figure 8:
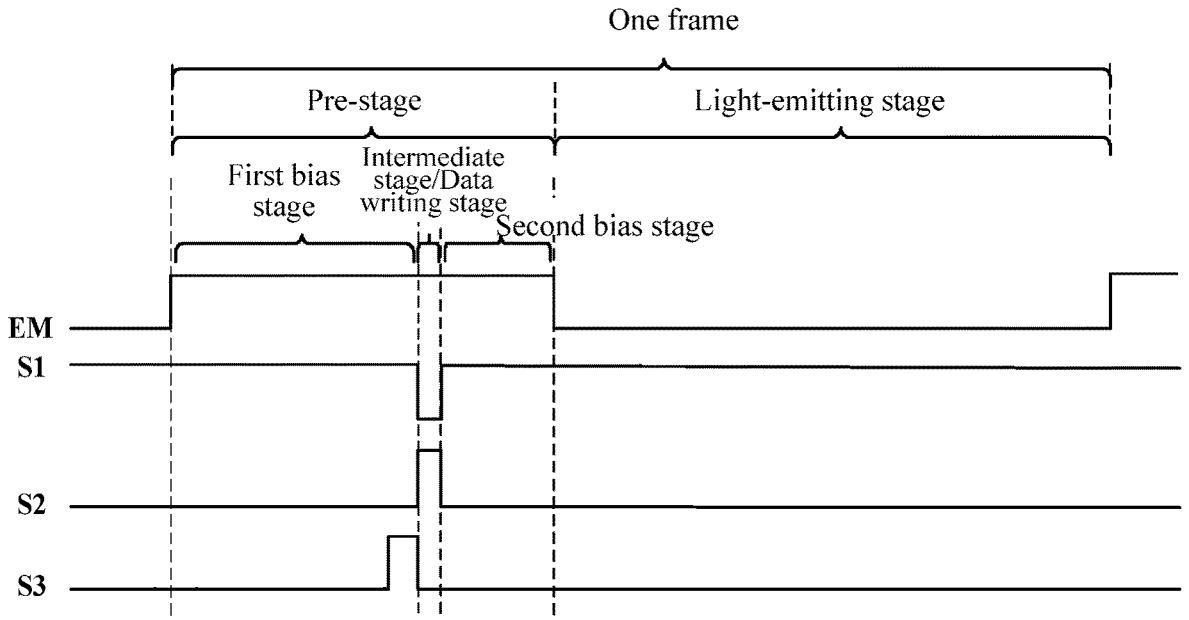
FIG. 8 is a schematic diagram of a fourth pixel circuit of a display panel according to an embodiment of the present disclosure.

The pixel circuit shown in FIG. 3 is used as an example. FIG. 8 is a schematic diagram of a fourth pixel circuit of a display panel according to an embodiment of the present disclosure. Referring to FIG. 8, in an embodiment, the third transistor T3 and the fifth transistor T5 are the NMOS transistors and the other transistors are the PMOS transistors, where the NMOS transistors may be the oxide semiconductor transistors.

In an embodiment, as shown in FIG. 8, the data writing frame includes the bias stage and the intermediate stage includes the data writing stage; and at the data writing stage, the data writing module 14, the drive module 11, and the compensation module 15 are all turned on and the data signal Vdata is written to the gate of the drive transistor T0. In the pixel circuit shown in FIG. 3, since the reset module 16 is connected to the gate of the drive transistor, the compensation module 15 does not need to be turned on at the reset stage. Therefore, at the reset stage, the light emission control signal EM and the bias module 13 can also control the drain potential of the drive transistor T0, that is, the bias stage and the reset stage can be performed at the same time. Therefore, in this embodiment, the intermediate stage may include merely the data writing stage. As described above, if the pre-stage further includes the reset stage, the bias stage at least partially overlaps the reset stage.

In this embodiment, a duration of the intermediate stage is less than a duration of the bias stage for the following reason: as described in the preceding embodiments, the intermediate stage mainly includes the reset stage or the data writing stage at which a related signal is written to the node, so the reset stage and the data writing stage need not be too long; as described above, the bias stage is performed to offset the threshold voltage drift of the drive transistor at the non-bias stage such as the light-emitting stage which generally takes a long time, so the bias stage also takes a certain time to fully achieve the bias effect. Therefore, the duration of the intermediate stage may be less than the duration of the bias stage.

In addition, in this embodiment, the pre-stage includes N bias stages, where N≥1. FIGS. 6 and 8 illustrate a case where the bias stage includes two bias stages. In other embodiments, three or more bias stages may be included. As shown in FIGS. 6 and 8, the bias stage includes a first bias stage and a second bias stage; and the pre-stage includes the first bias stage, the intermediate stage, and the second bias stage in sequence. In an embodiment, the duration of the intermediate stage is less than a duration of the first bias stage and a duration of the second bias stage. As described above, signals are written to the related node at the intermediate stage and the threshold voltage drift of the drive transistor at the non-bias stage is offset at the bias stage. Therefore, generally, the duration of the intermediate stage may be set to be less than the duration of the first bias stage and the duration of the second bias stage, so as to fully achieve the bias effect.

In addition, in some implementations, the duration of the first bias stage is equal to the duration of the second bias stage. In other implementations, the duration of one of the first bias stage and the second bias stage is at least greater than the duration of the other one of the first bias stage and the second bias stage. In this case, the bias stage with the greater duration may be selected as a primary bias stage and the other bias stage is an auxiliary bias stage. The primary bias stage is the main bias stage. However, to prevent the bias effect of the primary bias stage from being insufficient, the auxiliary bias stage may be performed to supplement the bias effect. In some cases, the duration of the first bias stage is greater than that of the second bias stage. In other cases, it is further optional that the duration of the first bias stage is less than that of the second bias stage.

In the case where the pre-stage includes the N bias stages, where N≥1, in an embodiment, any two bias stages in the pre-stage may have different durations. For example, the duration of the first bias stage is greater than the durations of the other bias stages, which may be understood as follows: the first bias stage is the primary bias stage and performed mainly to offset the threshold voltage drift at the non-bias stage. However, to prevent the bias effect of the first bias stage from being insufficient, the other auxiliary bias stages may be set to fully supplement the bias effect. On this basis, it may be set that in the pre-stage, the durations of the bias stages sequentially decrease, so that the insufficient bias effect of the former bias stage may be supplemented by the later bias stage. Based on the same concept, it may be set reversely, for example, the duration of the last bias stage is greater than the durations of the other bias stages. In particular, the durations of the bias stages in the pre-stage increase sequentially. The bias effect can be gradually achieved through the bias stages whose durations gradually increase. In addition, based on the preceding concepts, it may be further set that the duration of a certain intermediate bias stage is greater than the duration of the first bias stage and the duration of the second bias stage, that is, the last bias stages are used as auxiliary bias stages and one intermediate bias stage is used as the primary bias stage.

The preceding embodiments and those illustrated in FIGS. 4 to 8 are all for the case where the pre-stage includes the intermediate stage. In other implementations of this embodiment, the pre-stage may not include the intermediate stage.

Figure 9:
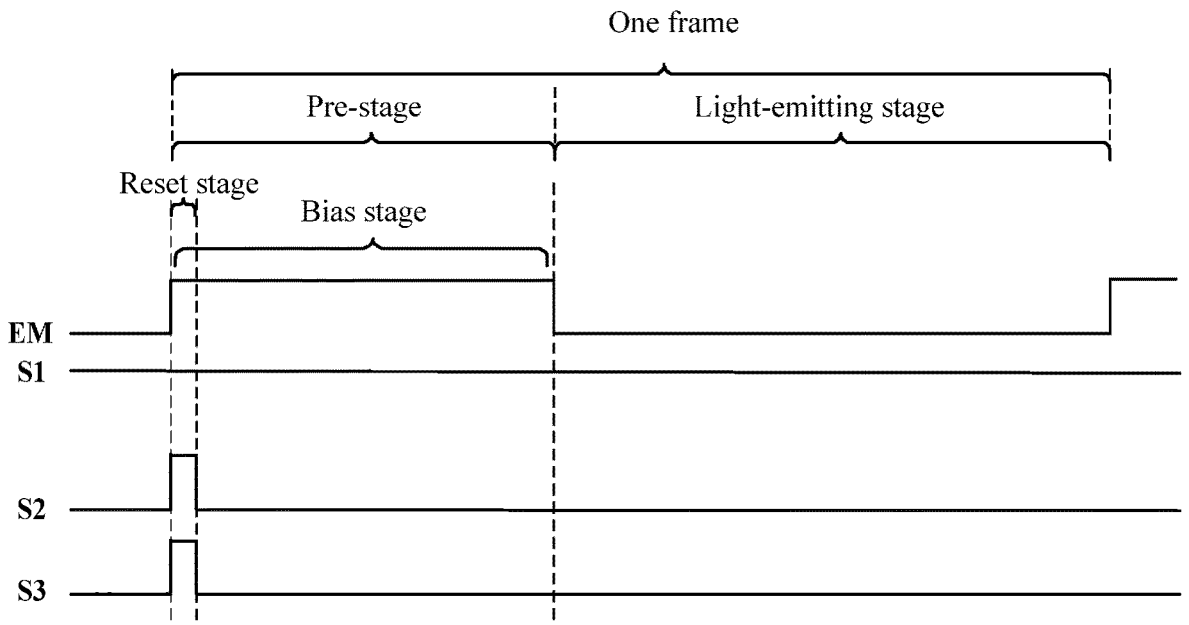
FIG. 9 is a schematic diagram of a fifth working timing sequence of a pixel circuit.

With reference to the pixel circuit in FIG. 3, FIG. 9 is a schematic diagram of a fifth working timing sequence of the pixel circuit. Referring to FIG. 9 which illustrates the working timing sequence of the retention frame, the retention frame includes the bias stage and the pre-stage further includes the reset stage. At the reset stage, the gate of the drive transistor T0 receives the reset signal Vref to be reset, where the reset stage at least partially overlaps the bias stage. The retention frame does not need the data writing stage. In the pixel circuit shown in FIG. 3, since the reset module 16 is connected to the gate of the drive transistor T0, the compensation module 15 does not need to be turned on at the reset stage, so that the reset stage is performed simultaneously with at least part of the bias stage. Such a setting can adjust the gate potential of the drive transistor T0 on the one hand and adjust the drain potential of the drive transistor T0 on the other hand, so as to simultaneously adjust the gate potential and the drain potential, reduce the potential difference between the gate potential and the drain potential, and improve the bias effect.

Figure 10:
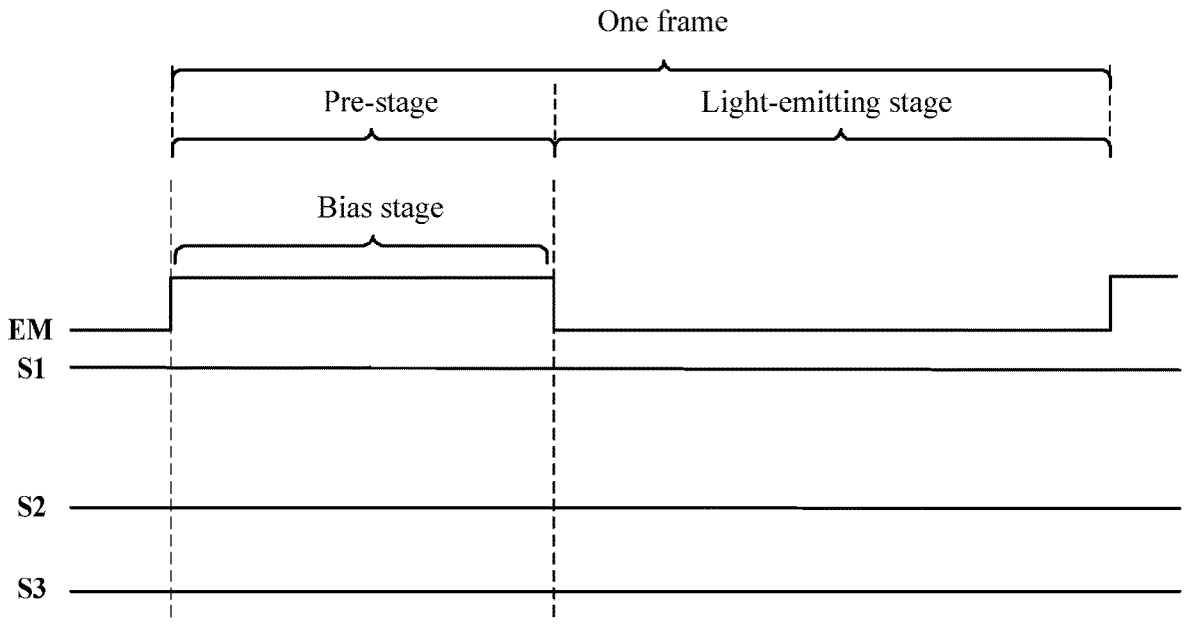
FIG. 10 is a schematic diagram of a sixth working timing sequence of a pixel circuit.

In addition, with reference to the pixel circuit in FIG. 3, FIG. 10 is a schematic diagram of a sixth working timing sequence of the pixel circuit. Referring to FIG. 10 which illustrates the working timing sequence of the retention frame, the retention frame includes the bias stage and the pre-stage of the retention frame is the bias stage. The retention frame includes no data writing stage. Therefore, if the retention frame does not include the reset stage, the compensation module 15 does not need to be turned on during the retention frame and the light emission control signal EM and the bias module 13 can control the drain potential of the drive transistor T0 throughout the pre-stage, so the pre-stage is the bias stage.

In this embodiment, as shown in FIGS. 1 to 3, the light emission control module 12 includes a first light emission control module 12*a* and a second light emission control module 12*b*; the first light emission control module 12*a* is connected between a first power signal terminal and the source of the drive transistor T0 and configured to selectively provide the drive module 11 with a first power signal PVDD; and the second light emission control module 12*b* is connected between the drain of the drive transistor T0 and the light-emitting element 20 and configured to selectively allow the drive current to flow into the light-emitting element 20.

In an embodiment, the first light emission control module 12*a* includes a fourth transistor T4, where a source of the fourth transistor T4 is connected to the first power signal terminal, a drain of the fourth transistor T4 is connected to the source of the drive transistor T0, and a gate of the fourth transistor T4 is connected to a light emission control signal terminal. The second light emission control module 12*b* includes a first transistor T1, where a source of the first transistor T1 is connected to the drain of the drive transistor T0, a drain of the first transistor T1 is connected to the light-emitting element 20, and a gate of the first transistor T1 is connected to the light emission control signal terminal.

In this embodiment, as shown in FIGS. 1 to 3, a control terminal of the first light emission control module 12*a* and a control terminal of the second light emission control module 12*b* are connected to the same light emission control signal line. This is applicable to the case where the first light emission control module 12*a* and the second light emission control module 12*b* may be simultaneously turned on and off.

Figure 11:
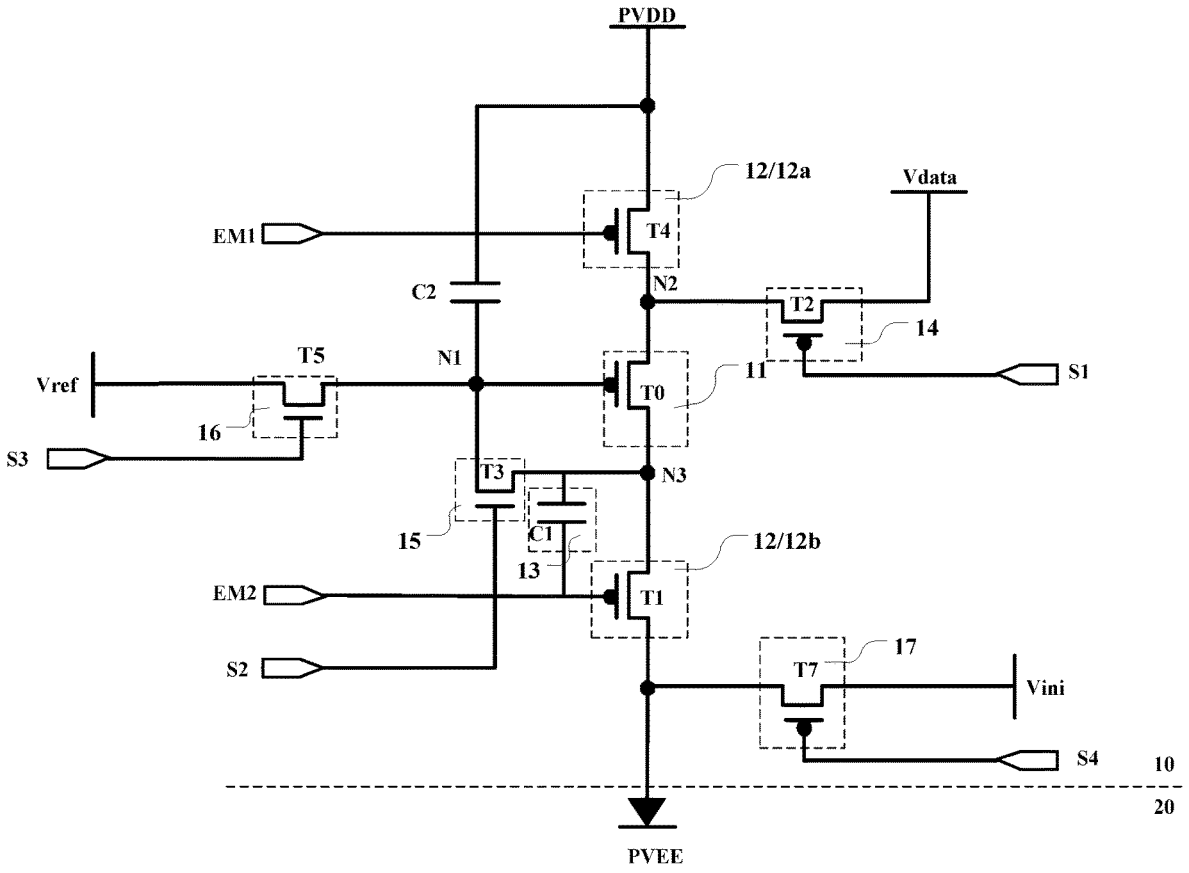
FIG. 11 is a schematic diagram of a fifth pixel circuit of a display panel according to an embodiment of the present disclosure.

In addition, in this embodiment, referring to FIG. 11 which is a schematic diagram of a fifth pixel circuit of a display panel according to an embodiment of the present disclosure, the control terminal of the first light emission control module 12*a* is connected to a first light emission control signal line for receiving a first light emission control signal EM1; and the control terminal of the second light emission control module 12*b* is connected to a second light emission control signal line for receiving a second light emission control signal EM2. The bias module 13 may be connected to the first light emission control signal line or the second light emission control signal line. When the bias module 13 is connected to the second light emission control signal line, since the first light emission control module 12*a* is connected to the first power signal terminal and the source of the drive transistor T0 and the second light emission control module 12*b* is connected between the drain of the drive transistor T0 and the light-emitting element 20, generally, to sufficiently make the drain of the drive transistor T0 disconnected from the light-emitting element 20 and ensure that the light-emitting element 20 does not emit light at a non-light-emitting stage, the second light emission control module 12*b* remains off at the non-light-emitting stage. If the first transistor T1 is the PMOS transistor, the second light emission control signal EM2 remains to be the high-level signal at the pre-stage. Therefore, it is set that the bias module is connected to the second light emission control signal line, which can ensure that at the pre-stage, the bias stage has a relatively great duration, facilitating the improvement of the bias effect.

As shown in FIG. 11, in this embodiment, the bias module 13 includes a first capacitor C1, where a first plate of the first capacitor C1 is connected to the drain of the drive transistor T0 and a second plate of the first capacitor C1 is connected to the light emission control signal line. At the bias stage, the first capacitor C1 increases or decreases the drain voltage of the drive transistor T0 according to the light emission control signal EM2 on the light emission control signal line. Since the capacitor has the function of being charged and discharged, the capacitor is set, so that the drain voltage of the drive transistor T0 can be controlled by the light emission control signal EM2. Meanwhile, no additional signal needs to be applied to control the capacitor. Therefore, the bias module 13 is configured to be the first capacitor C1, which can simplify the working process of the circuit.

In addition, in this embodiment, the pixel circuit further includes a second capacitor C2, where the second capacitor C2 includes a third plate connected to the first power signal terminal and a fourth plate connected to the gate of the drive transistor T0 and is configured to store the data signal Vdata transmitted to the gate of the drive transistor T0. In this embodiment, a capacitance value of the first capacitor C1 may be greater than or equal to a capacitance value of the second capacitor C2. In some embodiments, the capacitance value of the first capacitor C1 is smaller than the capacitance value C2 of the second capacitor. Since the function of the second capacitor is to store the data signal Vdata written to the gate of the drive transistor T0 and the data signal Vdata written to the gate of the drive transistor T0 is one factor for determining the drive current generated by the drive transistor T0 at the light-emitting stage, the capacitor with a strong storage capacity is required to fully store the signal for the drive transistor T0 at the data writing stage. However, currently the bias stage is performed to adjust the potential difference between the gate potential and the drain potential of the drive transistor T0. Therefore, from the perspective of accurate data storage, a storage capacity of the second capacitor is required more greatly than a storage capacity of the first capacitor. Therefore, in this embodiment, it is set that the capacitance value of the first capacitor C1 is smaller than the capacitance value of the second capacitor C2.

Further, the capacitance value of the first capacitor C1 and the capacitance value of the second capacitor C2 satisfy that $C2\times\frac{1}{8}\leq C1\leq C2\times\frac{1}{4}$. The inventor of the present application has found that when $C2\times\frac{1}{8}\leq C1\leq C2\times\frac{1}{4}$, the capacitance value of the first capacitor C1 can meet the requirements of the bias stage and the problem that too large a capacitance value of the first capacitor C1 results in an increase in load of the pixel circuit which affects the signal transmission of the light emission control signal line can be avoided.

Figure 12:
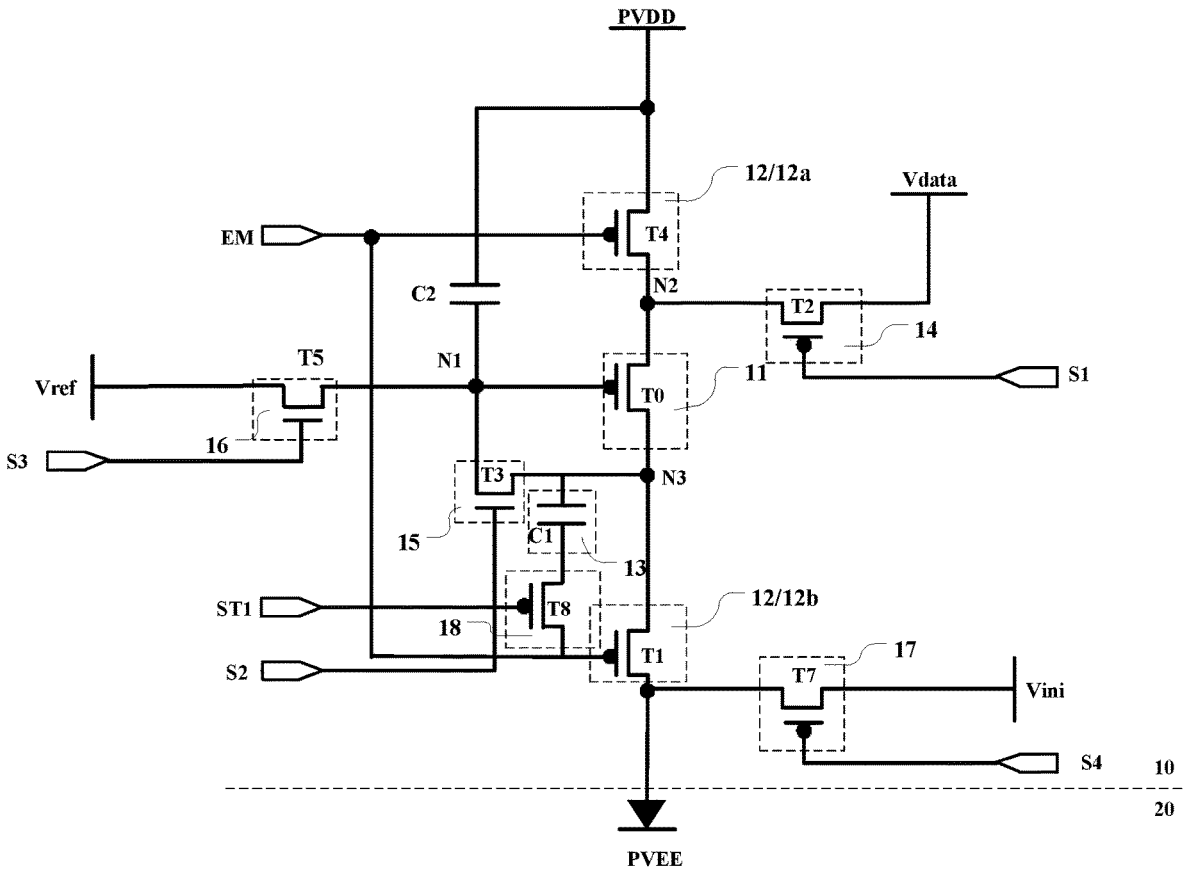
FIG. 12 is a schematic diagram of a sixth pixel circuit of a display panel according to an embodiment of the present disclosure.

Referring to FIG. 12 which is a schematic diagram of a sixth pixel circuit of a display panel according to an embodiment of the present disclosure, in this embodiment, the bias stage further includes a gating module 18, where the gating module 18 is connected between the light emission control signal line and the first capacitor C1 and configured to selectively allow the light emission control signal EM to control the drain potential of the drive transistor T0; and the gating module 18 includes a first bias transistor T8, where a source of the first bias transistor T8 is connected to the light emission control signal line, a drain of the first bias transistor T8 is connected to the first capacitor C1, and a gate of the first bias transistor T8 is connected to a first bias signal line for receiving a first bias signal ST1. When merely the first capacitor C1 is included between the light emission control signal line and the drain of the drive transistor T0, the start and end of the bias stage cannot be controlled at any time. As long as the compensation module 15 is turned off at the pre-stage, the bias stage is entered. In some cases, to better control the start and end of the bias stage, the gating module 18 is provided so that the start and end of the bias stage can be controlled by the first bias signal ST1.

Figure 13:
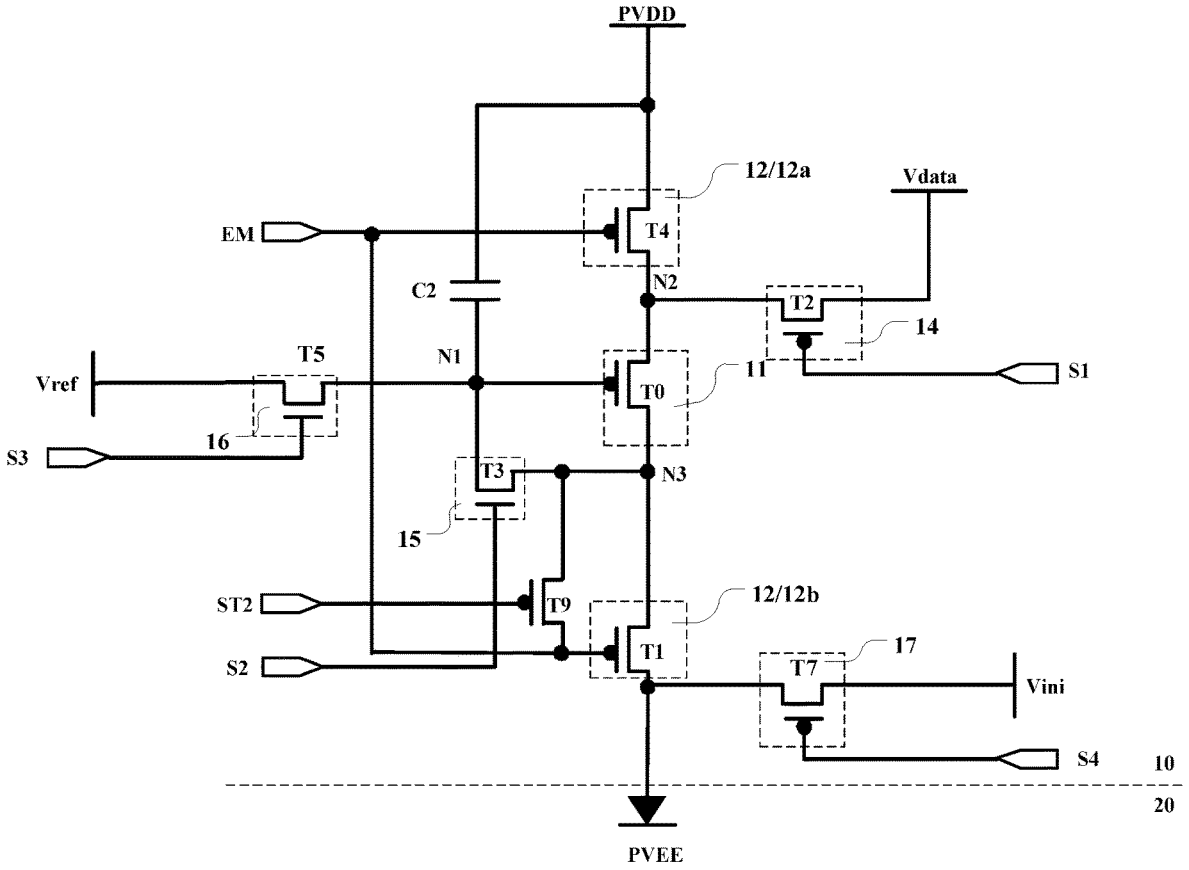
FIG. 13 is a schematic diagram of a seventh pixel circuit of a display panel according to an embodiment of the present disclosure.

Referring to FIG. 13 which is a schematic diagram of a seventh pixel circuit of a display panel according to an embodiment of the present disclosure, optionally, in this embodiment, the bias module 13 further includes a second bias transistor T9, where a source of the second bias transistor T9 is connected to the light emission control signal line, a drain of the second bias transistor T9 is connected to the drain of the drive transistor T0, and a gate of the second bias transistor T9 is connected to a second bias control signal line for receiving a second bias control signal ST2. At the bias stage, the second bias transistor T9 is turned on and the light emission control signal EM is transmitted to the drain of the drive transistor T0. In this case, the second bias transistor T9 is set and may be turned on at the beginning of the bias stage and turned off at the end of the bias stage, thereby controlling the start and end of the bias stage.

In an embodiment, as shown in FIGS. 1 to 3 and 11 to 13, in this embodiment, the pixel circuit further includes an initialization module 17, where the initialization module 17 is connected between an initialization signal terminal and the light-emitting element 20 and configured to selectively provide the light-emitting element 20 with an initialization signal Vini; and a control terminal of the initialization module 17 is connected to a fourth scanning signal line for receiving a fourth scanning signal S4.

In an embodiment, the initialization module 17 includes a seventh transistor T7, where a source of the seventh transistor T7 is connected to the initialization signal terminal, a drain of the seventh transistor T7 is connected to the light-emitting element 20, and a gate of the seventh transistor T7 is connected to the fourth scanning signal line.

When the initialization module 17 is turned on, the pixel circuit 10 enters an initialization stage. In this embodiment, the bias stage does not overlap the initialization stage. In some embodiments, the bias stage may partially overlap the initialization stage. At the bias stage, the display panel is required not to emit light, but the transistor might have a certain leakage current. Therefore, if the light-emitting element 20 receives no initialization signal Vini, the light-emitting element 20 may be at the risk of emitting light at the bias stage. Therefore, at the bias stage, the light-emitting element 20 is initialized, which can further ensure that the light-emitting element does not emit light. Further, the initialization stage may end earlier than the bias stage, simultaneously with the bias stage, or later than the bias stage. These solutions are all applicable. A flexible design is allowed according to the specific circuit.

In this embodiment, it may be set that a first bias control signal ST1 and the fourth scanning signal S4 are the same signal, or the second bias control signal ST2 and the fourth scanning signal S4 are the same signal. In this embodiment, the fourth scanning signal S4 controls the start and end of the initialization stage. As described above, the initialization stage may be performed at the bias stage, that is, the fourth scanning signal S4 is reused as the first bias control signal ST1 or the second bias control signal ST2, which can avoid the problem where too many drive signals are introduced into the display panel, which results in a larger working load of the display panel and an increase in the frame of the display panel.

In the present application, in an embodiment, part of T0, T1, T2, T3, T4, T5, and T6 may be PMOS transistors with polysilicon as an active layer and part of T0, T1, T2, T3, T4, T5, and T6 may be NMOS transistors with an oxide semiconductor as the active layer. For example, T3 and T5 are NMOS transistors and the other transistors are PMOS transistors. It is understandable that the effective pulse of a scanning signal for the NMOS transistor is at a high level and the effective pulse of a scanning signal for the PMOS transistor is at a low level. It is to be noted that the pixel circuits shown in FIGS. 1 to 13 are merely examples and not to limit the structure of the pixel circuit in the embodiments of the present disclosure.

In an embodiment, a width-to-length ratio of a channel region of the NMOS transistor is greater than that of a channel region of the PMOS transistor since the NMOS transistor mainly functions as a switch transistor and requires an ability of a quick response in the present application, and the transistor with the greater width-to-length ratio has the shorter channel region which helps to improve the responsive ability of the transistor.

In addition, in the present application, four scanning signals, S1, S2, S3, and S4, may be different. In some particular cases, for example, if the timing sequence meets a certain condition, at least two of the four signals, S1, S2, S3, and S4, may be the same signal. For example, when T5 and T7 are the same type of transistors such as PMOS transistors or NMOS transistors, S3 and S4 may be the same signal. In another example, when T3 and T7 are the same type of transistors such as PMOS transistors or NMOS transistors, S2 and S4 may be the same signal. A specific situation depends on a specific circuit structure and a timing sequence and is not particularly limited in this embodiment.

Based on the same concept, the embodiments of the present disclosure further provide a driving method of a display panel. In conjunction with FIG. 1, the display panel includes a pixel circuit 10 and a light-emitting element 20; where the pixel circuit 10 includes a drive module 11, a data writing module 14, a light emission control module 12, and a bias module 13; where the drive module 11 is configured to provide the light-emitting element 20 with a drive current and includes a drive transistor T0; the data writing module 14 is connected to a source of the drive transistor T0 and configured to selectively provide the drive module 11 with a data signal Vdata; the light emission control module 12 is configured to selectively allow the light-emitting element 20 to enter a light-emitting stage; a control terminal of the light emission control module 12 is connected to a light emission control signal line for receiving a light emission control signal EM; and the bias module 13 is connected between a drain of the drive transistor T0 and the light emission control signal line. A working process of the pixel circuit includes a bias stage at which the bias module 13 adjusts a drain potential of the drive transistor T0 in response to the light emission control signal EM.

A driving method for at least one frame of picture of the display panel includes steps described below.

In the case where a transistor in the light emission control module 12 and the drive transistor T0 are PMOS transistors, at the bias stage, the light emission control signal line receives a high-level signal and the bias module 13 increases a drain voltage of the drive transistor T0 according to the high-level signal to enable the drive transistor T0 to enter a bias state. Alternatively, in the case where the transistor in the light emission control module 12 and the drive transistor T0 are NMOS transistors, at the bias stage, the light emission control signal line receives a low-level signal and the bias module 13 decreases the drain voltage of the drive transistor T0 according to the low-level signal to enable the drive transistor T0 to enter the bias state.

In other implementations of this embodiment, the driving method may include the driving method used in the working process of the pixel circuit in any one of the embodiments described below. The same content will not be repeated in this embodiment, but it should be considered that all the driving methods described above fall within the scope of the driving method provided in this embodiment.

Figure 14:
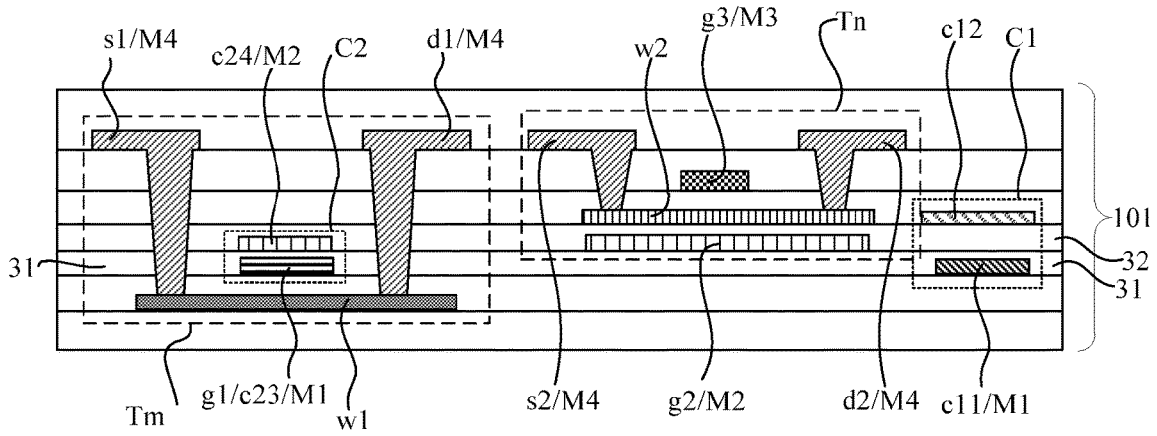
FIG. 14 is a partial sectional view of a pixel circuit according to an embodiment of the present disclosure.
Figure 15:
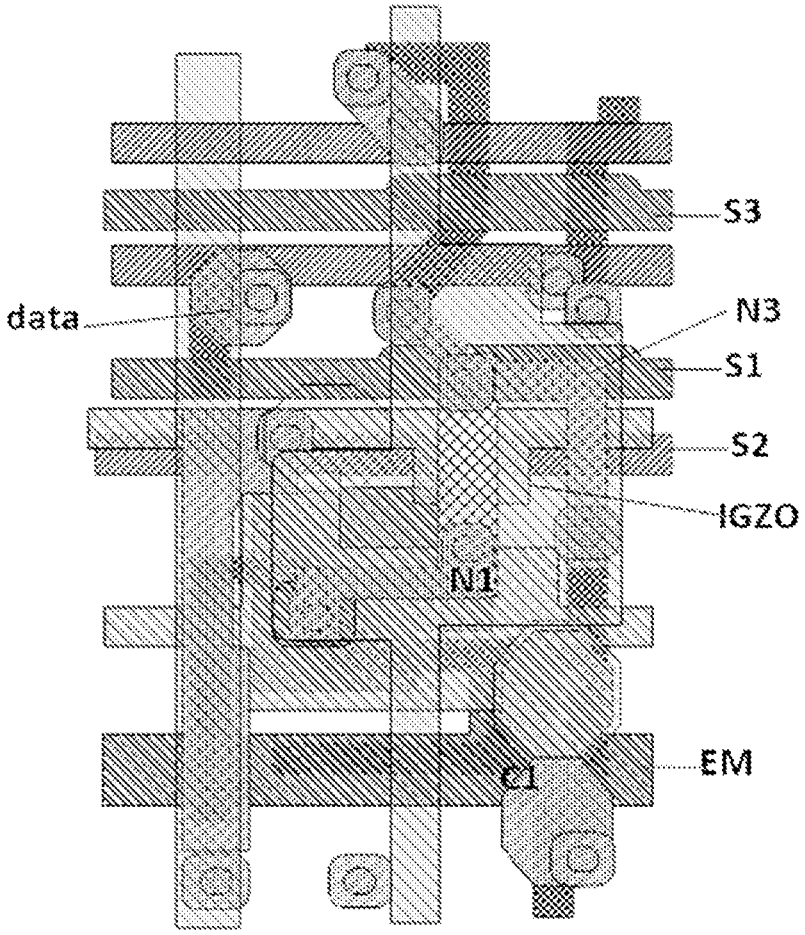
FIG. 15 is a top view of a pixel circuit according to an embodiment of the present disclosure.

FIG. 14 is a partial sectional view of a pixel circuit according to an embodiment of the present disclosure. FIG. 15 is a top view of a pixel circuit according to an embodiment of the present disclosure. Referring to FIGS. 14 and 15, the pixel circuit includes two types of transistors including a transistor Tm and a transistor Tn, where a gate of the transistor Tm is disposed in a first metal layer M1, a source and a drain of the transistor Tm are disposed in a fourth metal layer M4, and the transistor Tm includes a first active layer w1 disposed between the first metal layer M1 and a base substrate; the transistor Tn includes a first gate and a second gate, where the first gate is disposed in a second metal layer M2 and a second gate is disposed in a third metal layer M3; the transistor Tn includes a second active layer w2 disposed between the second metal layer M2 and the third metal layer M3; and a source and a drain of the transistor Tn are disposed in the fourth metal layer M4. The transistor Tm may be a low-temperature polysilicon transistor and the transistor Tn may be an oxide semiconductor transistor.

The pixel circuit includes a first capacitor C1 and a second capacitor C2, where the first capacitor C1 includes a first plate C11 and a second plate C12, and the second capacitor C2 includes a third plate C23 and a fourth plate C24. The first plate and the second plate are disposed in any two of the first active layer w1, the first metal layer M1, the second metal layer M2, the second active layer w2, the third metal layer M3, and the fourth metal layer. The third plate and the fourth plate are disposed in any two of the first active layer w1, the first metal layer M1, the second metal layer M2, the second active layer w2, the third metal layer M3, and the fourth metal layer M4.

In some cases, the first plate and the third plate are disposed in the same layer, and the second plate and the fourth plate are disposed in the same layer. In this case, an area of the first plate is smaller than that of the third plate, and an area of the second plate is smaller than that of the fourth plate, so that a capacitance value of the first capacitor C1 is smaller than that of the second capacitor C2.

In some cases, the first plate and the third plate are disposed in the same layer, and the second plate and the fourth plate are disposed in different layers. In an embodiment, a distance between the first plate and the second plate is greater than a distance between the third plate and the fourth plate, so that the capacitance value of the first capacitor C1 can be smaller than that of the second capacitor C2. In this case, in an embodiment, the first plate and the third plate are disposed in the first metal layer M1, the fourth plate is disposed in the second metal layer M2, and the second plate is disposed in the second active layer or the third metal layer M3 or the fourth metal layer M4.

In some cases, the first plate, the second plate, the third plate, and the fourth plate are disposed in different layers, and a specific position of each plate is in any one of the first active layer w1, the first metal layer M1, the second metal layer M2, the second active layer w2, the third metal layer M3, and the fourth metal layer M4, which is all within the scope of this case.

In an embodiment, a first insulating layer is included between the first plate and the second plate, and a second insulating layer is included between the third plate and the fourth plate, where a dielectric constant of the first insulating layer is smaller than that of the second insulating layer, so that the capacitance value of the first capacitor C1 is smaller than that of the second capacitor C2. In addition, in an embodiment, when the drive transistor is the PMOS transistor, the transistor Tm may be the drive transistor. In this case, the hydrogen content of the second insulating layer is greater than the hydrogen content of the first insulating layer. In this embodiment, the second capacitor C2 is a storage capacitor in the pixel circuit, the second capacitor C2 generally overlaps the drive transistor in a direction perpendicular to a surface of the display panel, and the drive transistor has a top-gate structure. Therefore, the second capacitor C2 is generally disposed on a side of the first active layer w1 facing away from the base substrate. In particular, the third plate C23 of the second capacitor C2 may be reused as the gate of the transistor Tm and the fourth plate may be disposed in the second metal layer M2 and overlap the gate of the transistor Tm. In this case, the drive transistor is the PMOS transistor and the low-temperature polysilicon transistor. An active layer in the low-temperature polysilicon transistor needs to be hydrogenated, resulting in the higher hydrogen content in its surrounding layer. Therefore, in this embodiment, the hydrogen content of the second insulating layer is greater than the hydrogen content of the first insulating layer.

In an embodiment, the oxygen content of the first insulating layer is greater than the oxygen content of the second insulating layer. Since the capacitance value of the first capacitor C1 is smaller than that of the second capacitor C2, in some cases, a thickness of the first insulating layer is greater than that of the second insulating layer. Therefore, at least one of the first plate or the second plate of the first capacitor C1 is closer to an active layer in the transistor Tn (that is, the active layer in the oxide semiconductor transistor) than the third plate and the fourth plate. To ensure the normal function of the oxide semiconductor transistor, a layer surrounding an oxide semiconductor active layer has relatively low hydrogen content and relatively high oxygen content. Therefore, in this case, the oxygen content of the first insulating layer is greater than the oxygen content of the second insulating layer.

In the embodiments of the present disclosure, the pixel circuit includes the bias module which is connected between the light emission control signal line and the drain of the drive transistor to adjust the drain potential of the drive transistor and improve a potential difference between a gate potential of the drive transistor and the drain potential of the drive transistor. It is known that the pixel circuit includes at least one non-bias stage. When the drive transistor generates the drive current, the gate potential of the drive transistor might be higher than the drain potential of the drive transistor, so that an I-V curve of the drive transistor deviates, resulting in a threshold voltage drift of the drive transistor. At the bias stage, the gate potential and the drain potential of the drive transistor are adjusted, so that the deviation of the I-V curve of the drive transistor at the non-bias stage can be balanced, thereby reducing the threshold voltage drift of the drive transistor and ensuring the display uniformity of the display panel.

Based on the same concept, the embodiments of the present disclosure further provide a display device including the display panel according to any one of the embodiments described above. In an embodiment, the display panel is an organic light-emitting display panel or a micro light-emitting diode (LED) display panel.

Figure 16:
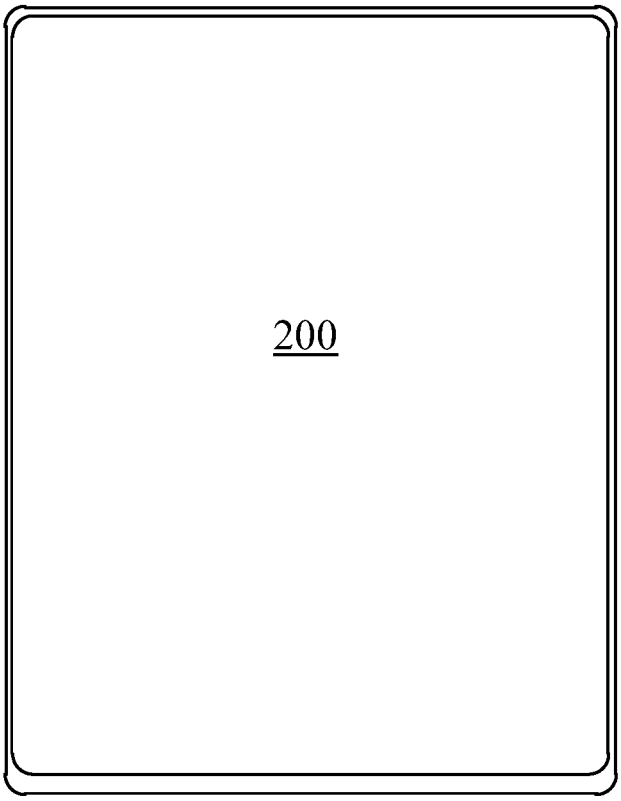
FIG. 16 is a schematic diagram of a display device according to an embodiment of the present disclosure.

Referring to FIG. 16 which is a schematic diagram of a display device according to an embodiment of the present disclosure, in an embodiment, the display device is applied to an electronic device 200 such as a smart phone and a tablet computer. It is understandable that the above-mentioned embodiments merely provide some examples of the structure of the pixel circuit and the driving method of the pixel circuit. The display panel further includes other structures, which will not be repeated here.

It is to be noted that the above are merely some embodiments of the present disclosure and the technical principles used therein. It is to be understood by those skilled in the art that the present disclosure is not limited to the embodiments described herein. Those skilled in the art can make various apparent modifications, adaptations, combinations, and substitutions without departing from the scope of the present disclosure. Therefore, though the present disclosure has been described in detail through the embodiments described above, the present disclosure is not limited to the embodiments described above and may include other equivalent embodiments without departing from the concept of the present disclosure. The scope of the present disclosure is determined by the scope of the appended claims.

What is claimed is:

1. A display panel, comprising:

a pixel circuit and a light-emitting element;

wherein the pixel circuit comprises a drive module, a data writing module, a light emission control module, and a bias module;

wherein the drive module is configured to provide the light-emitting element with a drive current and comprises a drive transistor;

wherein the data writing module is connected to a source of the drive transistor and configured to selectively provide the drive module with a data signal;

wherein the light emission control module is configured to selectively allow the light-emitting element to enter a light-emitting stage;

wherein a control terminal of the light emission control module is connected to a light emission control signal line for receiving a light emission control signal; and the bias module is connected between a drain of the drive transistor and the light emission control signal line; and wherein a working process of the pixel circuit comprises a bias stage at which the bias module adjusts a drain potential of the drive transistor according to the light emission control signal.

2. The display panel of claim 1, wherein the working process of the pixel circuit further comprises at least a non-bias stage;

at the bias stage, the drive transistor has a gate voltage of Vg1, a source voltage of Vs1, and a drain voltage of Vd1; and at the non-bias stage, the drive transistor has a gate voltage of Vg2, a source voltage of Vs2, and a drain voltage of Vd2; wherein $$(Vg1-Vd1)\times(Vg2-Vd2)<0.$$

3. The display panel of claim 2, wherein the bias stage has a duration of t1 and the non-bias stage has a duration of t2, wherein $$(|Vg1-Vd1|-|Vg2-Vd2|)\times(t1-t2)<0.$$

4. The display panel of claim 1, wherein a transistor in the light emission control module and the drive transistor are P-type metal-oxide-semiconductor (PMOS) transistors; and at the bias stage, the light emission control signal line receives a high-level signal and the bias module increases the drain potential of the drive transistor according to the high-level signal; or a transistor in the light emission control module and the drive transistor are N-type metal-oxide-semiconductor (NMOS) transistors; and at the bias stage, the light emission control signal line receives a low-level signal and the bias module decreases a drain potential of the drive transistor according to the low-level signal.

5. The display panel of claim 1, wherein the pixel circuit further comprises a compensation module;

the compensation module is connected between a gate of the drive transistor and the drain of the drive transistor and configured to compensate a threshold voltage of the drive transistor; and at the bias stage, the compensation module remains off.

6. The display panel of claim 5, wherein within one frame of picture of the display panel, the working process of the pixel circuit comprises a pre-stage and the light-emitting stage; and wherein within at least one frame of picture, the pre-stage of the pixel circuit comprises the bias stage.

7. The display panel of claim 6, wherein the pre-stage comprises the bias stage and an intermediate stage; wherein at the bias stage, the compensation module is turned off;

at the intermediate stage, the compensation module is turned on; and the bias stage precedes the intermediate stage, or the bias stage is after the intermediate stage.

8. The display panel of claim 7, wherein a data writing period of the display panel comprises S frames of a refresh picture which comprises a data writing frame and a retention frame, wherein S>0;

the data writing frame comprises a data writing stage; and the retention frame comprises no data writing stage.

9. The display panel of claim 8, wherein the pixel circuit further comprises a reset module; and the reset module is connected between a reset signal terminal and the drain of the drive transistor and configured to provide the gate of the drive transistor with a reset signal.

10. The display panel of claim 9, wherein the data writing frame comprises the bias stage; wherein the intermediate stage comprises a reset stage and the data writing stage in sequence;

at the reset stage, the reset module and the compensation module are turned on and the gate of the drive transistor receives the reset signal to be reset; and at the data writing stage, the data writing module, the drive module, and the compensation module are all turned on and the data signal is written to the gate of the drive transistor.

11. The display panel of claim 9, wherein the retention frame comprises the bias stage; wherein the intermediate stage comprises a reset stage; and at the reset stage, the reset module and the compensation module are turned on and the gate of the drive transistor receives the reset signal to be reset.

12. The display panel of claim 8, wherein the pixel circuit further comprises a reset module; and the reset module is connected between a reset signal terminal and the gate of the drive transistor and configured to provide the gate of the drive transistor with a reset signal.

13. The display panel of claim 12, wherein the data writing frame comprises the bias stage; wherein the intermediate stage comprises the data writing stage; and at the data writing stage, the data writing module, the drive module, and the compensation module are all turned on and the data signal is written to the gate of the drive transistor.

14. The display panel of claim 13, wherein the pre-stage further comprises a reset stage; and the bias stage at least partially overlaps the reset stage.

15. The display panel of claim 7, wherein the bias stage comprises a first bias stage and a second bias stage; and the pre-stage comprises the first bias stage, the intermediate stage, and the second bias stage in sequence;

wherein a duration of the intermediate stage is less than a duration of the first bias stage and a duration of the second bias stage, wherein a duration of one of the first bias stage and the second bias stage is at least greater than a duration of the other one of the first bias stage and the second bias stage.

16. The display panel of claim 6, wherein a data writing period of the display panel comprises S frames of a refresh picture which comprises a data writing frame and a retention frame, wherein S>0;

the retention frame comprises the bias stage; and the pre-stage of the retention frame is the bias stage.

17. The display panel of claim 1, wherein the bias module comprises a first capacitor, a first plate of the first capacitor is connected to the drain of the drive transistor, and a second plate of the first capacitor is connected to the light emission control signal line; and at the bias stage, the first capacitor increases or decreases the drain potential of the drive transistor according to the light emission control signal on the light emission control signal line.

18. The display panel of claim 17, wherein the pixel circuit further comprises a second capacitor, wherein the second capacitor comprises a third plate connected to a first power signal terminal and a fourth plate connected to a gate of the drive transistor and is configured to store the data signal transmitted to the gate of the drive transistor; and a capacitance value of the first capacitor is smaller than a capacitance value of the second capacitor.

19. The display panel of claim 18, wherein the first capacitor has a capacitance value of C1 and the second capacitor has a capacitance value of C2, and wherein $$C2\times\tfrac{1}{8}\leq C1\leq C2\times\tfrac{1}{4}.$$

20. A display device, comprising the display panel of claim 1.

* * * * *